US011530807B1

(12) United States Patent
Tang

(10) Patent No.: US 11,530,807 B1
(45) Date of Patent: Dec. 20, 2022

(54) LIGHTING DEVICE

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 0 days.

(21) Appl. No.: 17/581,071

(22) Filed: Jan. 21, 2022

(51) Int. Cl.
*F21V 23/06* (2006.01)
*F21S 4/28* (2016.01)

(52) U.S. Cl.
CPC ..... *F21V 23/06* (2013.01); *F21S 4/28* (2016.01)

(58) Field of Classification Search
CPC ..... F21V 23/007; F21V 23/06; F21V 23/008; H01R 33/76; H01R 13/207
See application file for complete search history.

(56) References Cited

U.S. PATENT DOCUMENTS 9,835,314 B1 * 12/2017 Wright ..... F21V 21/002

* cited by examiner

*Primary Examiner* — Anabel Ton
(74) *Attorney, Agent, or Firm* — Muncy, Geissler, Olds & Lowe, P.C.

(57) ABSTRACT

A lighting device is provided, including: an elongate light assembly, including a power connector, the power connector being configured for electrical connection of a power wire; a base, connected to the elongate light assembly; and a head portion, detachably connected to the base, including a threaded connector, the threaded connector being electrically connected with the elongate light assembly; wherein at least one of the power connector and the threaded connector is configured to be electrically connected with a power source.

9 Claims, 7 Drawing Sheets

LIGHTING DEVICE

BACKGROUND OF THE INVENTION

Field of the Invention

The present invention relates to a lighting device.

Description of the Prior Art

The invention of light bulbs allows people to move at night without restriction. There are various types of light bulbs such as conventional T8 fluorescent lamps, T5 lamps, LEDs, energy saving bulbs, etc., and several types of lamps are developed to meet various requirements; ceiling lamps, semi-ceiling lamps, pendant lamps, downlights, wall lamps, for instance.

Strip lamps are the most common in daily life. However, sockets for connection of most of the conventional strip lamp are directly fixed to the ceiling, and the sockets are directly connected to wires arranged on the building. This kind of socket has a large size and needs to be connected to the wires, which causes a lot of inconvenience and lack of safety in installation.

The present invention is, therefore, arisen to obviate or at least mitigate the above-mentioned disadvantages.

SUMMARY OF THE INVENTION

The main object of the present invention is to provide a lighting device which has a small size, is easy to install, and provides two options of electric connection to a power source.

To achieve the above and other objects, a lighting device is provided, including: an elongate light assembly, including a power connector, the power connector being configured for electrical connection of a power wire; a base, connected to the elongate light assembly; and a head portion, detachably connected to the base, including a threaded connector, the threaded connector being electrically connected with the elongate light assembly; wherein at least one of the power connector and the threaded connector is configured to be electrically connected with a power source.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
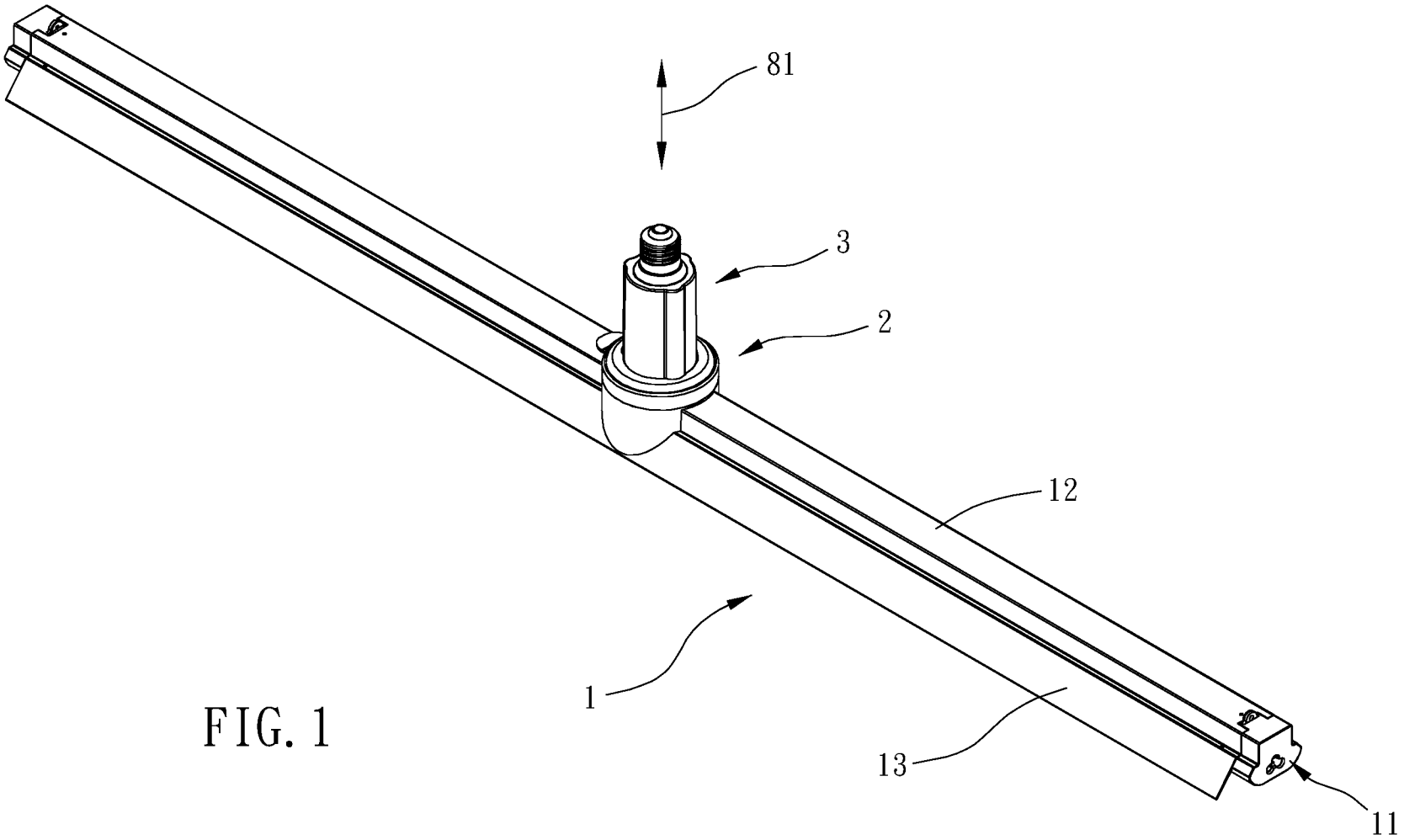
FIG. 1 is a stereogram of a preferable embodiment of the present invention.
Figure 2:
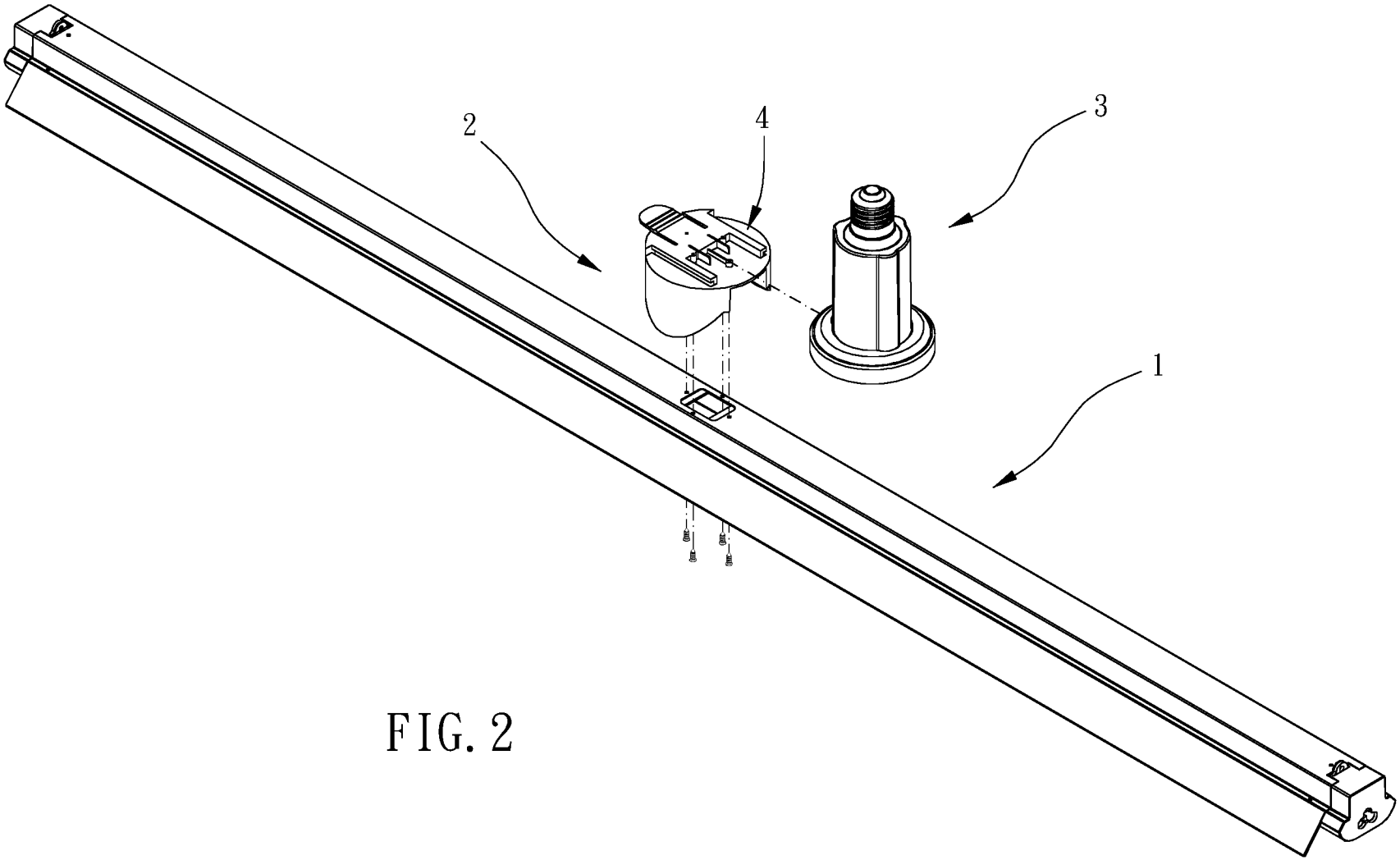
FIG. 2 is a breakdown drawing of a preferable embodiment of the present invention.
Figure 3:
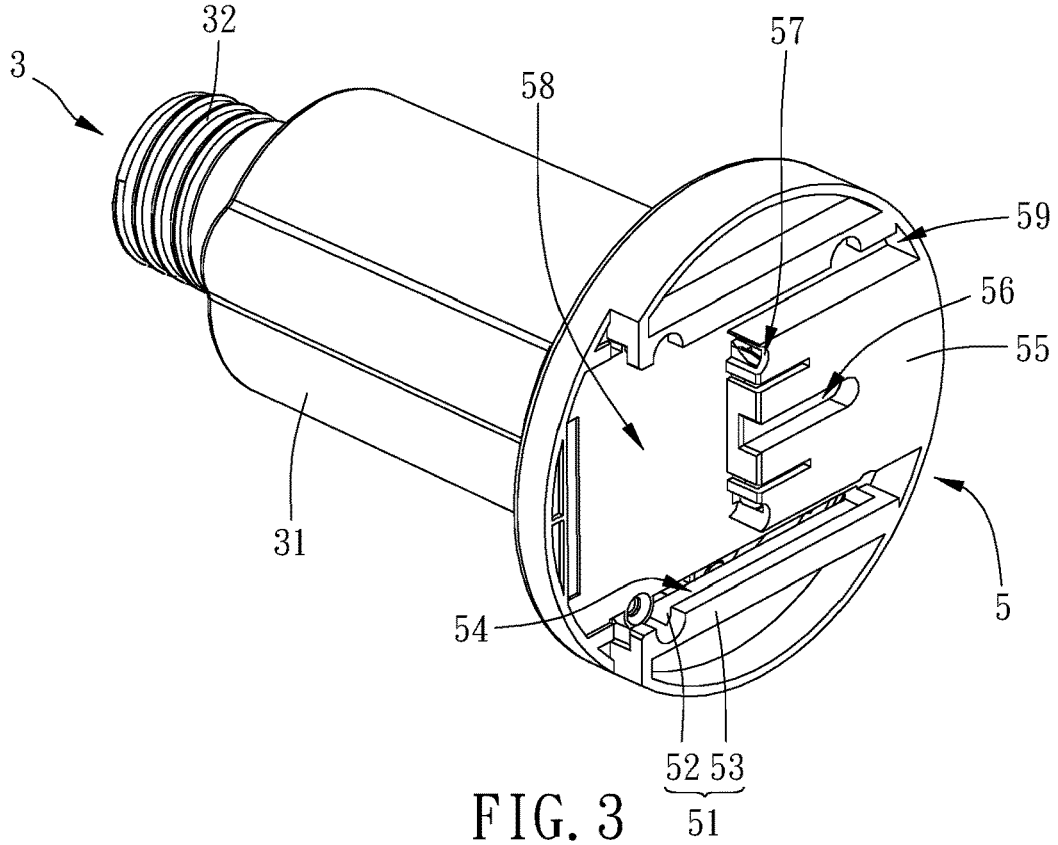
FIG. 3 is a stereogram of a head portion of a preferable embodiment of the present invention.
Figure 4:
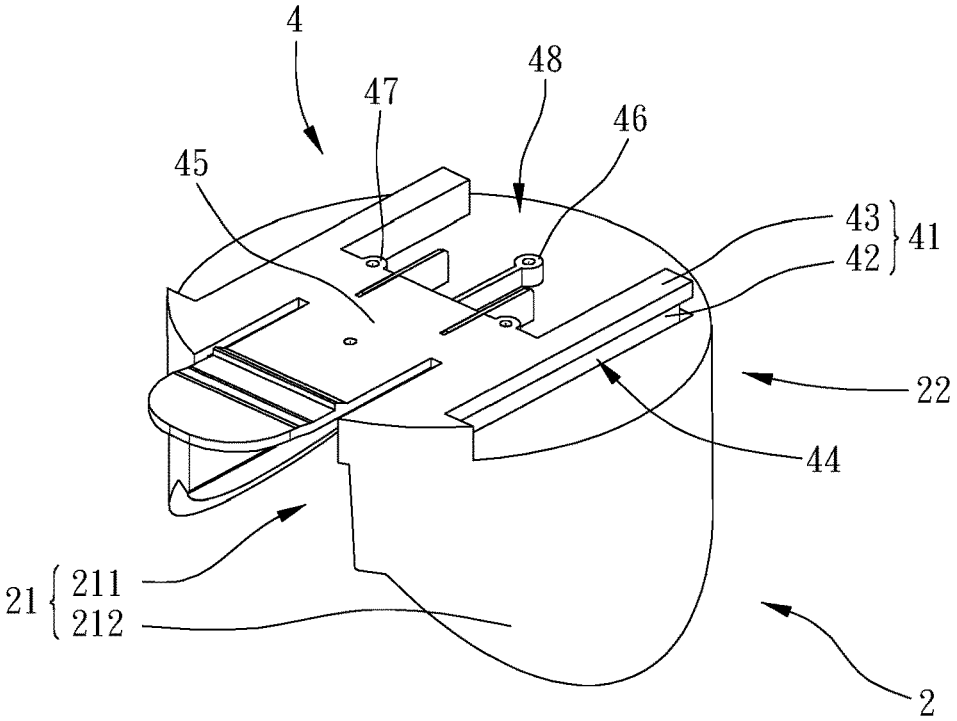
FIG. 4 is a stereogram of a base of a preferable embodiment of the present invention.
Figure 5:
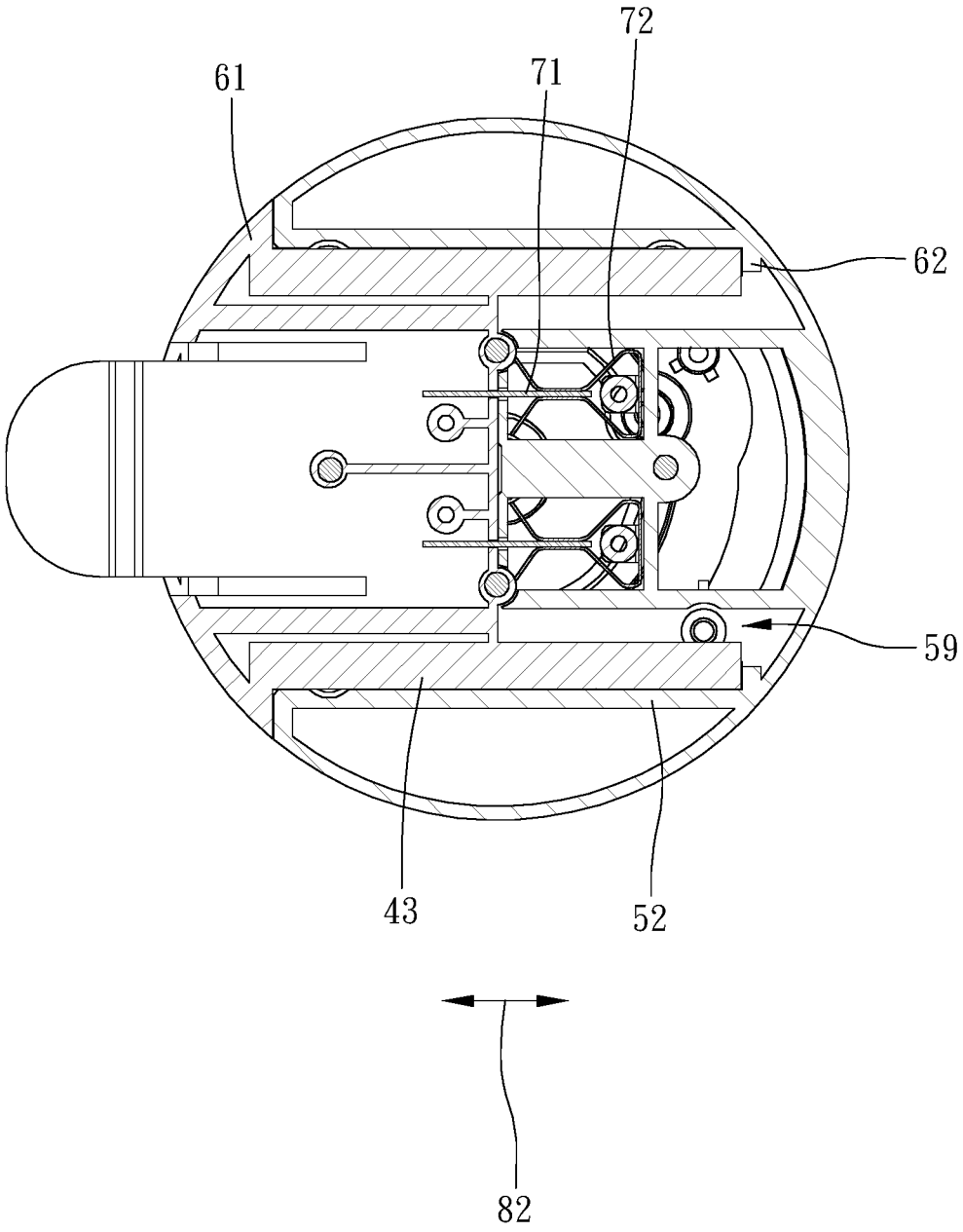
FIG. 5 is a cross-sectional view showing the head portion and the base combined according to a preferable embodiment of the present invention.
Figure 6:
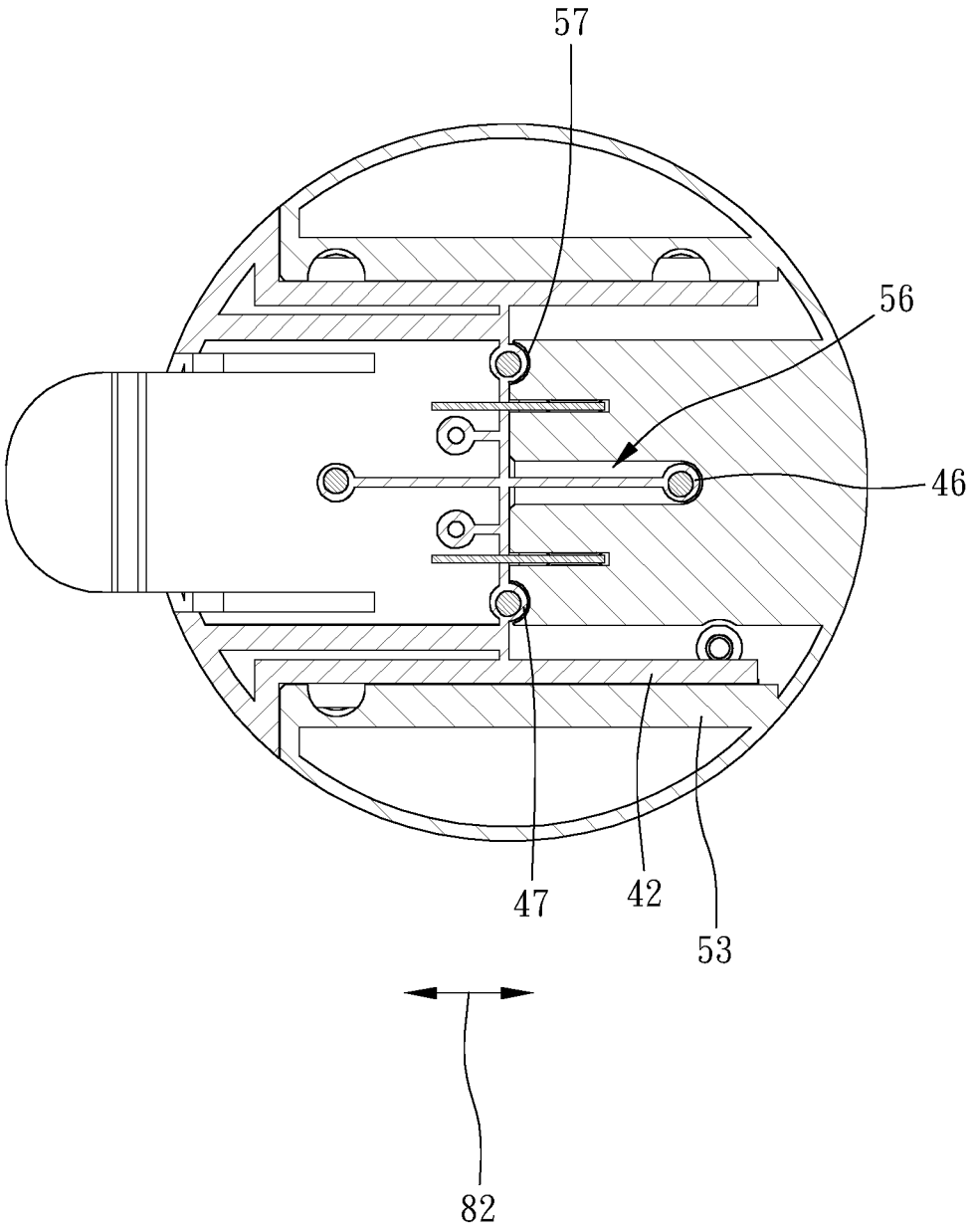
FIG. 6 is another cross-sectional view showing the head portion and the base combined according to a preferable embodiment of the present invention.
Figure 7:
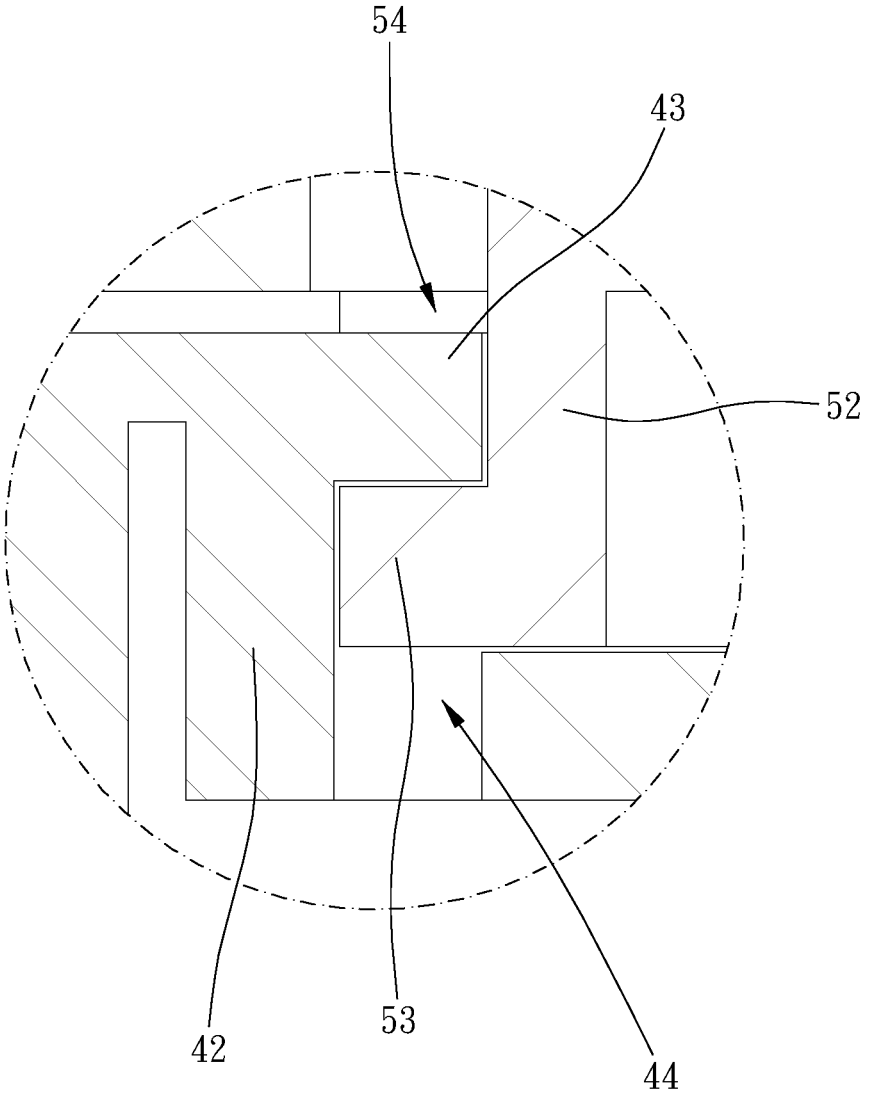
FIG. 7 is a partial cross-sectional view showing combination of a first track and a second track according to a preferable embodiment of the present invention.
Figure 8:
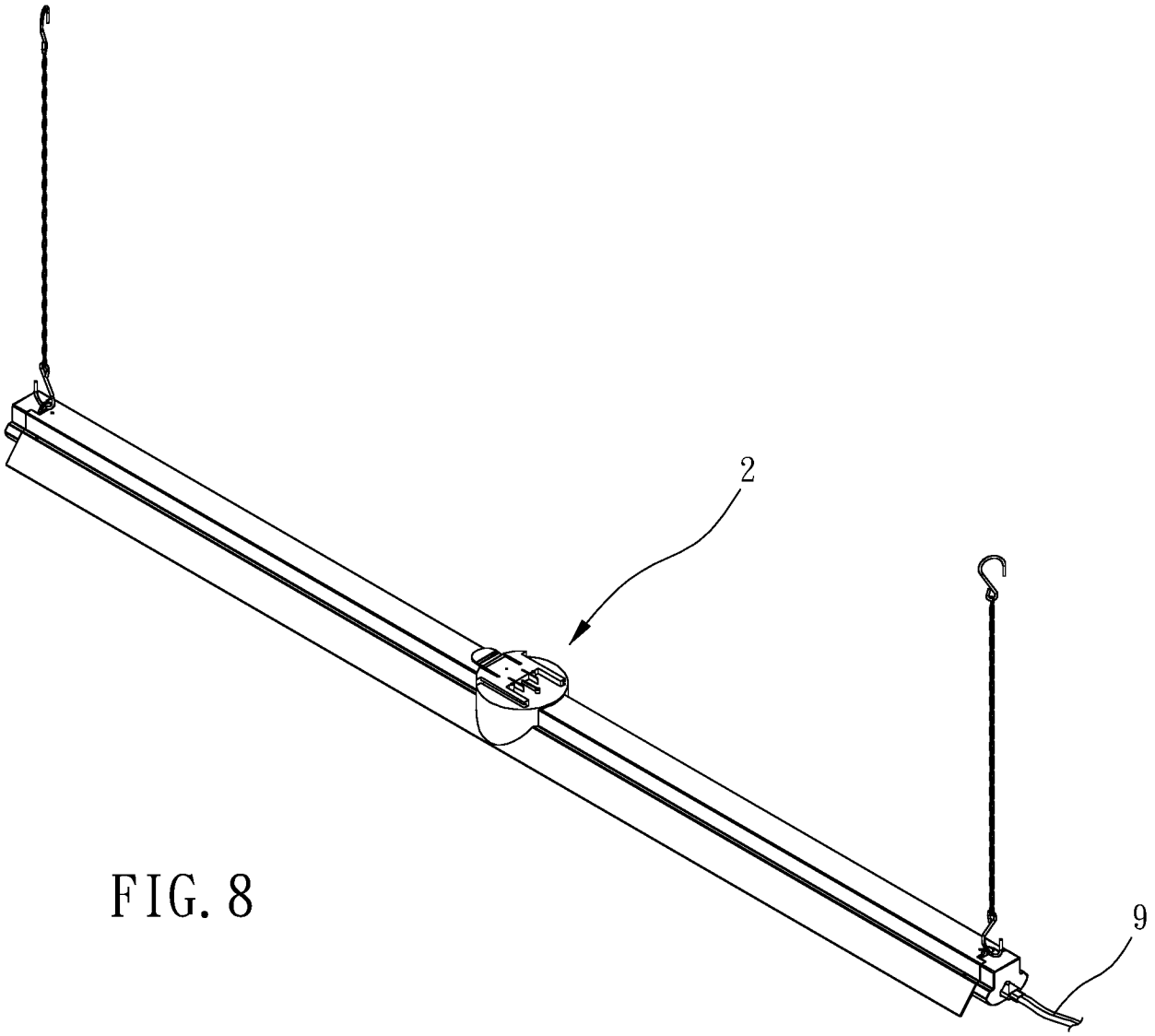
FIG. 8 is a stereogram showing application of a lighting device according to a preferable embodiment of the present invention.

Please refer to FIGS. 1 to 8 for a preferable embodiment of the present invention. A lighting device 1 of the present invention includes an elongate light assembly 1, a base 2 and a head portion 3.

The elongate light assembly 1 includes a power connector 11, and the power connector 11 is configured for optionally electrical connection of a power wire 9 so that the elongate light assembly 1 is electrically connected with a power source. The base 2 is connected to the elongate light assembly 1. The head portion 3 is detachably connected to the base 2, the head portion 3 includes a threaded connector 32, the threaded connector 32 is electrically connected with the elongate light assembly 1, and the threaded connector 32 is configured to be electrically connected with a power source. At least one of the power connector 11 and the threaded connector 32 is optionally connected electrically with the power source to drive the elongate light assembly 1 to light. The lighting device provides two options of electric connection to the power source, which is convenient.

Specifically, the base 2 is assembled to the elongate light assembly 1 along a first direction 81, and the base 2 includes an attachment portion 21, an assembling portion 22, a first connection member 4 and at least one first conductive member 71 which are connected. The attachment portion 21 is connected with the elongate light assembly 1, the first connection member 4 and the at least one first conductive member 71 are connected with the assembling portion 22, and the at least one first conductive member 71 is electrically connected with the elongate light assembly 1. In this embodiment, the elongate light assembly 1 includes a light strip 12 and a reflector 13, and the attachment portion 21 includes a notch 211 and two side portions 212. When the base 2 is connected to the elongate light assembly 1, the light strip 12 is engaged within the notch 211, and the two side portions 212 are protrusive beyond the notch 211 and cover a part of the reflector 13. The two side portions 212 can support and restrict the reflector 13.

Specifically, the head portion 3 is assembled to the base 2 along the first direction 81, the head portion 3 includes a main body 31, a second connection member 5 and at least one second conductive member 72, the threaded connector 32 is disposed on an end of the main body 31, the second connection member 5 and the at least one second conductive member 72 are disposed on another end of the main body 31, and the at least one second conductive member 72 is electrically connected with the threaded connector 32. The second connection member 5 is detachably assembled to the first connection member 4 along a second direction 82 so that the head portion 3 is connected to the base 2 and so that the at least one first conductive member 71 and the at least one second conductive member 72 are abutted and electrically connected with each other, wherein the second direction 82 is lateral to the first direction 81.

The base 2 can be slidably assembled to or disassembled from the head portion 3, which is easy and quick to replace or clean the elongate light assembly 1. The head portion 3, the base 2 or the elongate light assembly 1 can be replaced individually when it is out of working.

Specifically, the first connection member 4 includes two first tracks 41, the two first tracks 41 extend in the second direction 82, and each of the two first tracks 41 includes a first side wall 42 and a first flange 43 which define a first engaging groove 44. An end of the first side wall 42 is connected to the assembling portion 22, and the first flange 43 is connected laterally to another end of the first side wall 42. The second connection member 5 includes two second tracks 51, the two second tracks 51 extend in the second direction 82, and each of the two second tracks 51 includes a second side wall 52 and a second flange 53 which define a second engaging groove 54. An end of the second side wall 52 is connected to the main body 31, and the second flange 53 is connected laterally to another end of the second side wall 52. When the first flange 43 is inserted into the second engaging groove 54 along the second direction 82, the second flange 53 is inserted into the first engaging groove 44 along the second direction 82 at the same time, and the first flange 43 and the second flange 53 are blocked with each other in the first direction 81, so that the head portion 3 and the base 2 are stably connected. In this embodiment, as viewed in the second direction 82, the first side wall 42 and the first flange 43 are configured to be L-shaped, and the second side wall 52 and the second flange 53 are configured to be L-shaped. The first engaging grooves 44 of the two first tracks 41 and the second engaging grooves 54 of the two second tracks 51 are open opposite to each other.

Specifically, the first connection member 4 further includes a first main body 45, the at least one first conductive member 71 is positioned to the first main body 45, the two first tracks 41 are arranged in interval to define a first receiving space 48, the first engaging groove 44 is not in communication with the first receiving space 48, and the first main body 45 is disposed within the first receiving space 48. The second connection member 5 further includes a second main body 55, the at least one second conductive member 72 is positioned to the second main body 55, the two second tracks 51 are arranged in interval to define a second receiving space 58, the second engaging groove 54 is in communication with the second receiving space 58, the second main body 55 is disposed within the second receiving space 58, and the second main body 55 and the two second tracks 51 define two slots 59.

When the head portion 3 is connected to connected to the base 2, the two first tracks 41 and the first main body 45 are inserted within the second receiving space 58, the two first tracks 41 are inserted in the two slots 59, and the second main body 55 is inserted within the first receiving space 48, so that the head portion 3 and the base 2 are stably and firmly connected.

The first main body 45 and the second main body 55 provide sufficient space for receiving the at least one first conductive member 71 and the at least one second conductive member 72 and have good structural strength for positioning the at least one first conductive member 71 and the at least one second conductive member 72. In this embodiment, the two first tracks 41 are symmetrically arranged relative to the first main body 45, and the two second tracks 51 are symmetrically arranged relative to the second main body 55. The at least one first conductive member includes two first conductive members 71, and the at least one second conductive member includes two second conductive members 72, the two first conductive members 71 are plate-shaped, the two second conductive members 72 are clip-shaped, the two first conductive members 71 and the two second conductive members 72 are connected by insertion, respectively, along the second direction 82.

Preferably, the first connection member 4 further includes two first blocking walls 61, and the second connection member 5 further including two second blocking walls 62. When the head portion 3 is connected to the base 2, the two first blocking walls 61 block the two second tracks 51 and the two second blocking walls 62 block the two first tracks 41.

Preferably, a first positioning portion 46 extends on the first main body 45 along the second direction 82, a second positioning portion 56 extends on the second main body 55 along the second direction 82, one of the first positioning portion 46 and the second positioning portion 56 includes a rib, and the other of the first positioning portion 46 and the second positioning portion 56 includes a recess. When the head portion 3 is connected to the base 2, the first positioning portion 46 and the second positioning portion 56 are connected by insertion. with the first positioning portion 46 and the second positioning portion 56 it provides functions as follows: when the two first tracks 41 or the two second tracks 51 are damaged, the first positioning portion 46 and the second positioning portion 56 can guide the head portion 3 to move along the second direction 82 relative to the base 2; when the two first blocking walls 61 or the two second blocking walls 62 are damaged, the first positioning portion 46 and the second positioning portion 56 can serve as a stop for blocking the head portion 3 on the second direction 82 and/or on a direction perpendicular to the first direction 81 and the second direction 82.

Preferably, at least one first abutting portion 47 extends on the first main body 45 along the second direction 82, and at least one second abutting portion 57 extends on the second main body 55 along the second direction 82. One of the at least one first abutting portion 47 and the at least one second abutting portion 57 includes a projection, and the other of the at least one first abutting portion 47 and the at least one second abutting portion 57 includes a recess. When the head portion 3 is connected to the base 2, the projection is engaged within the recess, which improves combination of the head portion 3 and the base 2.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lighting device, including:

an elongate light assembly, including a power connector, the power connector being configured for electrical connection of a power wire;

a base, connected to the elongate light assembly; and a head portion, detachably connected to the base, including a threaded connector, the threaded connector being electrically connected with the elongate light assembly;

wherein at least one of the power connector and the threaded connector is configured to be electrically connected with a power source;

wherein the base is assembled to the elongate light assembly along a first direction, the base includes an attachment portion, an assembling portion, a first connection member and at least one first conductive member which are connected, the attachment portion is connected with the elongate light assembly, the first connection member and the at least one first conductive member are connected with the assembling portion, the at least one first conductive member is electrically connected with the elongate light assembly; the head portion is assembled to the base along the first direction, the head portion includes a main body, a second connection member and at least one second conductive member, the threaded connector is disposed on an end of the main body, the second connection member and the at least one second conductive member are disposed on another end of the main body, the at least one second conductive member is electrically connected with the threaded connector: the second connection member is detachably assembled to the first connection member along a second direction so that the head portion is connected to the base and so that the at least one first conductive member and the at least one second conductive member are abutted and electrically connected with each other, wherein the second direction is lateral to the first direction.

2. The lighting device of claim 1, wherein the first connection member includes two first tracks, the two first tracks extend in the second direction, each of the two first tracks includes a first side wall and a first flange which define a first engaging groove, an end of the first side wall is connected to the assembling portion, and the first flange is connected laterally to another end of the first side wall; the second connection member includes two second tracks, the two second tracks extend in the second direction, each of the two second tracks includes a second side wall and a second flange which define a second engaging groove, an end of the second side wall is connected to the main body, and the second flange is connected laterally to another end of the second side wall; when the first flange is inserted into the second engaging groove along the second direction, the second flange is inserted into the first engaging groove along the second direction at the same time, and the first flange and the second flange are blocked with each other in the first direction.

3. The lighting device of claim 2, wherein the first engaging grooves of the two first tracks and the second engaging grooves of the two second tracks are open opposite to each other.

4. The lighting device of claim 2, wherein the first connection member further includes a first main body, the at least one first conductive member is positioned to the first main body, the two first tracks are arranged in interval to define a first receiving space, and the first main body is disposed within the first receiving space; the second connection member further includes a second main body, the at least one second conductive member is positioned to the second main body, the two second tracks are arranged in interval to define a second receiving space, and the second main body is disposed within the second receiving space, and the second main body and the two second tracks define two slots; when the head portion is connected to the base, the two first tracks and the first main body are inserted within the second receiving space, the two first tracks are inserted in the two slots, and the second main body is inserted within the first receiving space.

5. The lighting device of claim 4, wherein a first positioning portion extends on the first main body along the second direction, a second positioning portion extends on the second main body along the second direction, one of the first positioning portion and the second positioning portion includes a rib, the other of the first positioning portion and the second positioning portion includes a recess, and when the head portion is connected to the base, the first positioning portion and the second positioning portion are connected by insertion.

6. The lighting device of claim 4, wherein at least one first abutting portion extends on the first main body along the second direction, at least one second abutting portion extends on the second main body along the second direction, one of the at least one first abutting portion and the at least one second abutting portion includes a projection, the other of the at least one first abutting portion and the at least one second abutting portion includes a recess; when the head portion is connected to the base, the projection is engaged within the recess.

7. The lighting device of claim 4, wherein the first connection member further includes two first blocking walls, the second connection member further includes two second blocking walls, and when the head portion is connected to the base, the two first blocking walls block the two second tracks and the two second blocking walls block the two first tracks.

8. The lighting device of claim 1, wherein the elongate light assembly includes a light strip and a reflector, the attachment portion includes a notch and two side portions, and when the base is connected to the elongate light assembly, the light strip is engaged within the notch, and the two side portions are protrusive beyond the notch and cover a part of the reflector.

9. The lighting device of claim 6, wherein the first engaging grooves of the two first tracks and the second engaging grooves of the two second tracks are open opposite to each other; a first positioning portion extends on the first main body along the second direction, a second positioning portion extends on the second main body along the second direction, one of the first positioning portion and the second positioning portion includes a rib, the other of the first positioning portion and the second positioning portion includes a recess, and when the head portion is connected to the base, the first positioning portion and the second positioning portion are connected by insertion; the first connection member further includes two first blocking walls, the second connection member further including two second blocking walls, and when the head portion is connected to the base, the two first blocking walls block the two second tracks and the two second blocking walls block the two first tracks; the elongate light assembly includes a light strip and a reflector, the attachment portion includes a notch and two side portions, and when the base is connected to the elongate light assembly, the light strip is engaged within the notch, and the two side portions are protrusive beyond the notch and cover a part of the reflector; as viewed in the second direction, the first side wall and the first flange are configured to be L-shaped, and the second side wall and the second flange are configured to be L-shaped; the at least one first conductive member includes two first conductive members, the at least one second conductive member includes two second conductive members, the two first conductive members are plate-shaped, the two second conductive members are clip-shaped; the two first tracks are symmetrically arranged relative to the first main body, and the two second tracks are symmetrically arranged relative to the second main body.

* * * * *